US009849505B2

(12) United States Patent
Anderseck et al.

(10) Patent No.: US 9,849,505 B2
(45) Date of Patent: Dec. 26, 2017

(54) METHOD AND APPARATUS FOR PRODUCING METAL SHEETS

(71) Applicant: Ulrich Bruhnke, Ehningen (DE)

(72) Inventors: Ralf Anderseck, Rudelzhausen (DE); Andreas Jaeger, Dortmund (DE); Karl-Heinz Lindner, Muelheim (DE)

(73) Assignee: Ulrich Bruhnke, Ehningen (DE)

( * ) Notice: Subject to any disclaimer, the term of this patent is extended or adjusted under 35 U.S.C. 154(b) by 138 days.

(21) Appl. No.: 14/892,012

(22) PCT Filed: May 13, 2014

(86) PCT No.: PCT/DE2014/000246
§ 371 (c)(1),
(2) Date: Nov. 18, 2015

(87) PCT Pub. No.: WO2017/187442
PCT Pub. Date: Nov. 27, 2014

(65) Prior Publication Data

US 2016/0096221 A1 Apr. 7, 2016

(30) Foreign Application Priority Data

May 18, 2013 (DE) ..... 10 2013 008 635

(51) Int. Cl.
*B21C 37/02* (2006.01)
*B22D 21/00* (2006.01)
(Continued)

(52) U.S. Cl.
CPC ..... *B22D 21/007* (2013.01); *B21C 23/06* (2013.01); *B21C 35/023* (2013.01); *B21C 35/03* (2013.01);
(Continued)

(58) Field of Classification Search
CPC ... B21D 1/05; B21D 3/02; B21D 3/12; B21D 3/14; B21D 25/00; B21D 25/04;
(Continued)

(56) References Cited

U.S. PATENT DOCUMENTS 1,133,903 A 3/1915 Wright
1,423,361 A * 7/1922 Rockwell ..... B21C 23/06 29/33 C
(Continued)

FOREIGN PATENT DOCUMENTS

CN 101579817 A 11/2009
CN 102179422 B 3/2013
(Continued)

*Primary Examiner* — Edward Tolan
(74) *Attorney, Agent, or Firm* — Smartpat PLC

(57) ABSTRACT

Metal sheets (13) are produced from strand-shaped profiles (8) having a low thickness, made of magnesium or magnesium alloys by way of an extrusion system (1). The open or closed extruded profile (8) exiting the extrusion die (6-7) of an extrusion press (1) is shaped to obtain a flat metal sheet (13) and is then subjected to a defined shaping process by way of stretch-forming. The system for carrying out the method is essentially composed of an extrusion press (1) comprising a die plate generating the extruded profile and a shaping unit (5) following the die plate, wherein the shaping unit (5) is composed of a severing unit (2), a bending unit (3), and an unrolling unit (4).

5 Claims, 6 Drawing Sheets

(51) Int. Cl.

| | |
|---|---|
| ***B21C 23/06*** | (2006.01) |
| ***B21C 35/02*** | (2006.01) |
| ***B21C 35/03*** | (2006.01) |
| ***B21D 1/00*** | (2006.01) |
| ***C22C 23/00*** | (2006.01) |
| ***B21D 5/00*** | (2006.01) |
| ***B21D 35/00*** | (2006.01) |
| ***B22D 11/00*** | (2006.01) |
| ***B22D 11/04*** | (2006.01) |
| ***B22D 11/12*** | (2006.01) |
| ***B22D 11/126*** | (2006.01) |
| ***B22D 11/14*** | (2006.01) |
| ***B22D 11/16*** | (2006.01) |
| ***B22D 21/04*** | (2006.01) |
| *B21D 25/04* | (2006.01) |
| *B21C 23/08* | (2006.01) |

(52) U.S. Cl.
CPC ..... *B21C 37/02* (2013.01); *B21D 1/00* (2013.01); *B21D 5/00* (2013.01); *B21D 35/005* (2013.01); *B22D 11/001* (2013.01); *B22D 11/04* (2013.01); *B22D 11/126* (2013.01); *B22D 11/1206* (2013.01); *B22D 11/1226* (2013.01); *B22D 11/1233* (2013.01); *B22D 11/14* (2013.01); *B22D 11/163* (2013.01); *B22D 21/04* (2013.01); *C22C 23/00* (2013.01); *B21C 23/085* (2013.01); *B21D 25/04* (2013.01)

(58) Field of Classification Search
CPC ... B21D 35/005; B21C 23/085; B21C 35/023; B21C 35/026; B21C 35/03; B22D 11/1206; B22D 11/126; B22D 11/14
See application file for complete search history.

(56) References Cited

U.S. PATENT DOCUMENTS

| | | | | | |
|---|---|---|---|---|---|
| 2,133,874 | A | | 10/1938 | Sparks | |
| 2,681,734 | A | | 6/1954 | Braeuninger | |
| 2,692,421 | A | * | 10/1954 | Cozzo | B21C 35/03 29/897.32 |
| 2,716,805 | A | * | 9/1955 | Reed | B21C 23/10 29/890.043 |
| 2,742,692 | A | * | 4/1956 | Braeuninger | B21C 35/026 428/582 |
| 2,798,286 | A | * | 7/1957 | Anderson | B21C 23/06 29/423 |
| 2,802,509 | A | * | 8/1957 | Anderson | B21C 23/06 72/176 |
| 3,022,255 | A | | 10/1961 | Grossu | |
| 3,342,055 | A | * | 9/1967 | Blankenship | B21C 23/21 72/253.1 |
| 3,442,000 | A | * | 5/1969 | Dornbos | B21C 23/14 29/417 |
| 4,187,711 | A | * | 2/1980 | Lavochkin | B21C 23/10 29/DIG. 47 |
| 5,829,298 | A | | 11/1998 | Linsenbardt et al. | |
| 5,848,545 | A | * | 12/1998 | Michisaka | B21C 23/14 72/253.1 |
| 6,070,448 | A | | 6/2000 | Eipper | |
| 6,138,489 | A | * | 10/2000 | Eriksson | B21D 53/02 29/890.03 |
| 6,862,911 | B2 | * | 3/2005 | Birkenstock | B21C 23/12 72/254 |
| 2011/0030439 | A1 | | 2/2011 | Maier et al. | |

FOREIGN PATENT DOCUMENTS

| | | | |
|---|---|---|---|
| CN | 103008377 | B | 10/2015 |
| DE | 43 33 500 | | 3/1996 |
| DE | 102 47 129 | | 4/2004 |
| DE | 101 50 021 | | 8/2005 |
| DE | 103 17 080 | | 4/2006 |
| DE | 10 2007 002 322 | | 7/2008 |
| DE | 10 2008 048 576 | | 3/2010 |
| DE | 102008048496 | A1 | 4/2010 |
| GB | 556061 | | 9/1943 |
| GB | 2469549 | | 10/2010 |
| JP | H07100553 | A | 4/1995 |

* cited by examiner

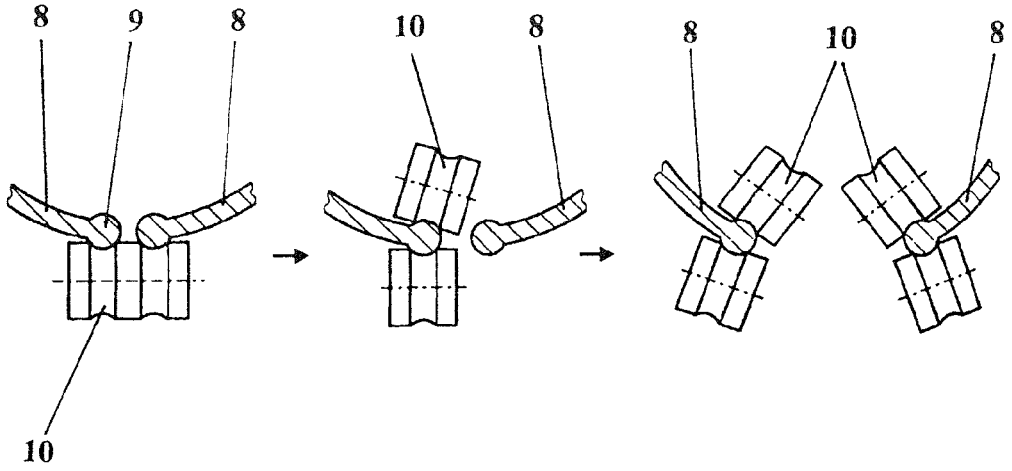
Fig. 4
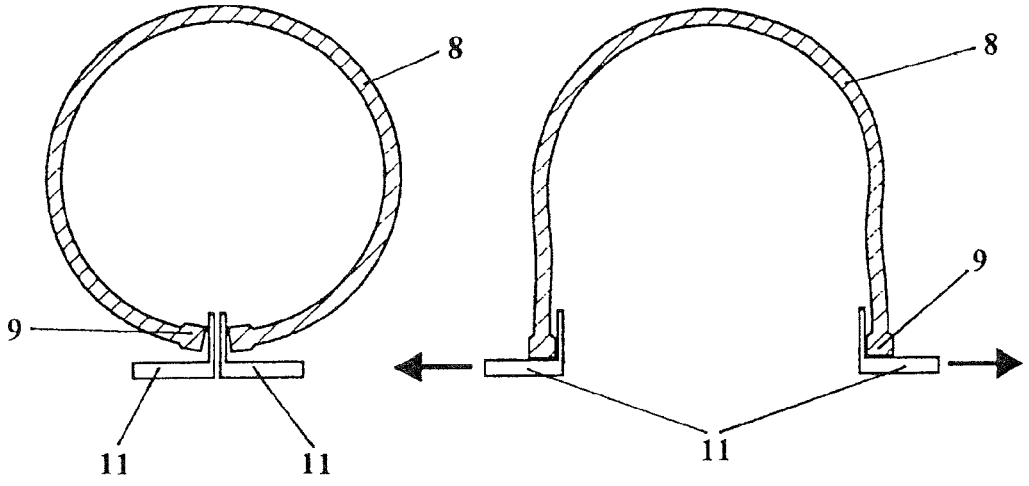
Fig. 5a
Fig. 5b

METHOD AND APPARATUS FOR PRODUCING METAL SHEETS

The invention relates to a method and to a system for producing metal sheets from strand-shaped profiles having a low thickness, which are produced in particular from magnesium or magnesium alloys, by way of an extrusion system.

Producing sheet metal by casting liquid alloy between two rollers and subsequently using numerous rolling and heat treatment processes is generally known. Due to the large number of reduction passes from the heavy plate to the thin sheet, this method is very cost-intensive. The steps are necessary to achieve a formable wrought structure from a cast structure. The high number of reduction passes is cost-intensive.

DE 101 50 021 B4 discloses a method and a device for producing profiles or sheet metal parts from magnesium or magnesium alloys by way of forming, under compressive conditions using extrusion, rolling, forging or casting, wherein the liquid melt is introduced into a continuous casting or extrusion unit to produce a semi-finished product, and immediately thereafter this semi-finished product is given the net shape thereof by way of forming in the warm state, wherein the temperature of the material after solidification from the melt is maintained in a range of 250° C. to 530° during the entire manufacturing operation, and the manufacturing process from casting to cooling of the formed parts is carried out as a whole in an inert atmosphere or under vacuum.

The device for carrying out these method steps is characterized in that the system is composed of a chain of a melting furnace, a continuous casting or extrusion unit, with or without roil stand, a cutting unit, one or more presses, and a cooling unit, the collectivity or parts of the aforementioned units being disposed in a protective gas chamber or vacuum chamber.

Moreover a method for producing formed sheet metal parts from magnesium is described in DE 103 17 080 B4, in which a formed sheet metal part can be produced immediately following the rolling process by way of forming using at least one press in a temperature range of >350° C. to 450° C. The device described for carrying out this method, which is composed of a chain of a melting furnace or crucible, a continuous casting unit, one or more roll stands, a cutting unit, one or more presses, and a cooling unit and is operated in a protective gas chamber or vacuum chamber, is characterized in that a stamping unit, which can be used to introduce dimensionally and cross-sectionally stable stamped holes and/or formed holes into blanks coming from the cutting device, is provided between the cutting unit and the press designed as a forming press.

DE 102 47 129 A1 describes another method for producing profiles or formed sheet metal parts from magnesium or magnesium alloys, in which a semi-finished product in the form of a metal sheet is given the net shape thereof by way of forming, preferably by way of compression molding, wherein the surface is freed from impurities in a method step immediately prior to the forming operation by way of chip removing, and preferably by way of shaving.

The disadvantage that remains with this method is that it is only possible to produce parts having a limited width, since larger parts command significantly added effort for the working pressures that are to be controlled. The tool and the machine frame must withstand the pressing pressure that is present during the manufacture of the semi-finished products or the parts, together with a corresponding counter-pressure, and therefore must necessarily be dimensioned considerably larger.

DE 43 33 500 02 discloses a method for producing a metal sheet that is stepped in the cross-section and has a solid profile and different wall thicknesses, in which first a semi-finished product is produced, the cross-section of which is similar to the cross-section of the metal sheet in the thickness direction, and in which the semi-finished product is rolled to obtain a metal sheet, wherein, for the production of the semi-finished product, a hollow profile having a wall thickness progression that is distributed over the periphery and corresponds to the desired wall thickness progression of the semi-finished product is extruded, and the hollow profile is severed along a peripheral surface line and formed to obtain the semi-finished product. In addition, two complementary profiles are laid one upon the other, wherein at least one of the profiled contact sides of the complementary profiles is provided with a parting agent, and the two complementary profiles are rolled out simultaneously using cylindrical, which is to say norm stepped, rolls. Prior to rolling, the two complementary profiles are severed on two opposing peripheral surface lines.

This method is used to produce two parts, respectively. The manufacturing process is discontinuous, and only relatively narrow parts can be produced. Other disadvantages are that the manufacturing process is relatively complex due to the manufacturing of the semi-finished product that is implemented with two different wall thicknesses and a stepped roll system.

A method for producing formed sheet metal parts and a device for carrying out the method are known from DE 10 2008 048 576 A1. The method comprises the steps of—extruding or continuously casting a tubular body,—cutting open the tubular body in the longitudinal direction of the same,—expanding the tubular body to obtain a planar body, finishing the planar body to obtain a component in correspondence with the drawing by way of manufacturing technologies that are known per se. The device is essentially composed of a chain of a melting unit, a continuous casting or extrusion unit, a longitudinal cutting unit, a roll stand, and one or more forming units.

A method for producing metal sheets or sheet metal parts from lightweight metal, preferable magnesium, is known from DE 10 2007 002 322 A1, wherein in one or more preceding method steps an extruded profile having an open structure, or a closed structure with subsequent cutting to form an open structure, is produced, and the same is subsequently subjected in one or more steps to a roller straightening process and a roller bending process across multiple rolling and bending stages.

It is the object of the invention to provide a method and a system for producing metal sheets from strand-shaped profiles have a low thickness, in particular from magnesium or magnesium alloys, wherein the open or closed extruded profiles exiting an extrusion die can be formed to obtain a metal sheet.

According to the invention, this object is achieved by the method and the system as in the claims. The open or closed extruded profile exiting the extrusion die of an extrusion press is shaped to obtain a flat metal sheet and is then subjected to a defined shaping process by way of stretch-forming.

The extruded profile exiting the die plate is cut corresponding to the length of the metal sheet to be produced, and the open or closed extruded profile is bent open to obtain a U-shaped profile, wherein the closed profile is previously severed along the peripheral surface line. Thereafter, the U-shaped profile is transferred into an unrolling unit and gripped by way of gripping elements on the longitudinal sides of the U-shaped profile, so as to shape the U-shaped profile by way of the outwardly moving gripping elements to obtain a metal sheet. Subsequently, the metal sheets are smoothed in a defined stretch-forming process.

Shaping of the U-shaped profile to obtain a metal sheet can be supported by a roller pair, which is moved into the U-shaped profile, and by moving each of the individual rollers in the direction of the edge regions located on the longitudinal sides.

Shaping to obtain the metal sheet preferably takes place in a temperature range above 200° C. and in a preferably inert atmosphere.

The system is composed of an extrusion press comprising a die plate generating the extruded profile and a shaping unit following the die plate, wherein the shaping unit is composed of a severing unit, a bending unit, and an unrolling unit. The unrolling unit can be composed of either two movable gripping elements or of one fixed gripping element and one movable gripping element. As an alternative, the unrolling unit can be composed of two movable rollers that can be moved into the U-shaped profile, wherein the individual rollers can be moved away from each other in the direction of the edge regions.

Another option of designing the unrolling unit is for the same to be formed of a combination of gripping elements and two movable rollers that can be moved into the U-shaped profile. So as to protect the surface of the metal sheet to be produced, the rollers can be provided with a heat-resistant elastic surface coating. The rollers that are used for this purpose are designed so as not to cause any surface damage.

Advantageous refinements and embodiments of the invention will be apparent from the remaining dependent claims and from the exemplary embodiment described hereafter in terms of the principle thereof.

The invention will be described in more detail based on one exemplary embodiment. In the drawings.

Figure 3A:
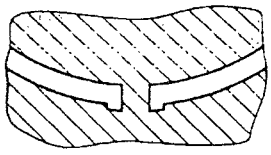
Figure 3B:
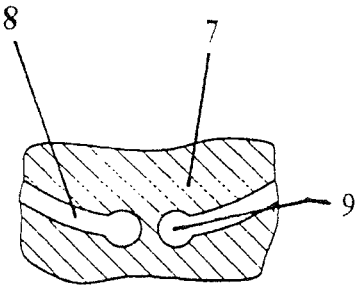

FIGS. 3*a* to *b* show variants of the profiled ends;

FIG. 4 shows the expansion by way of rollers;

FIGS. 5*a* to *g* show the tool concept for open profiles.

Figure 1:
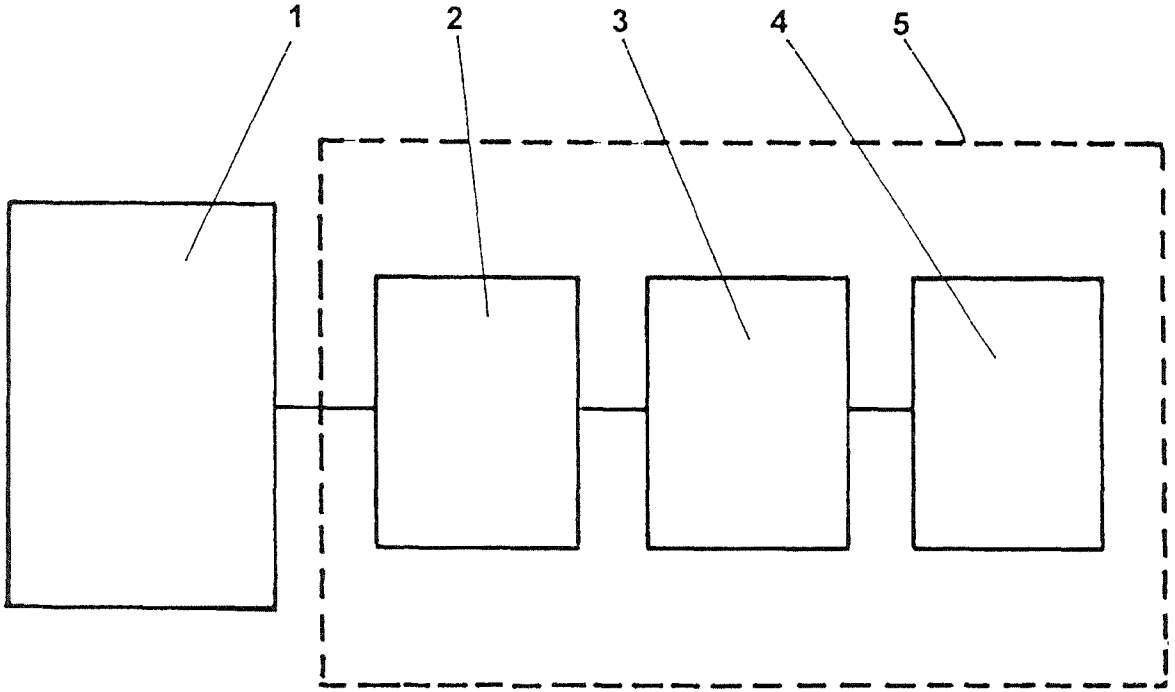
FIG. 1 shows a composition of the system in terms of the principle thereof.

FIG. 1 shows the composition of the system in terms of the principle thereof for carrying out the method for producing metal sheets from extruded profiles. The system is essentially composed of an extrusion press for producing an extruded profile and a forming unit 5. The forming unit is composed of a severing unit 2, a bending unit 3, and an unrolling unit 4.

Using the extrusion press 1, a round billet made of a magnesium alloy is formed to obtain an extruded profile, for example a tubular profile. The extrusion press 1 is stopped when the tubular profile has reached the length that corresponds to the predefined length of the metal sheet. The tubular profile is cut to size by way of the severing unit 2.

The severing unit 2 can be composed of a revolving jet nozzle, a laser, cutting rollers, or a co-rotating saw. If the severing of the tubular profile is carried out by way of metal-cutting, a suction device is provided so as to minimize a risk of fire from magnesium chips or magnesium dust. There is also the option to introduce a notch having a depth of 25% to 85% of the wall thickness at the separation point and to tear off the section of the tubular profile.

The severed section of the tubular profile is then forwarded to the bending unit 3. Here, the section of the tubular profile is severed along a peripheral surface line and bent open to obtain a U-shaped profile by way of a slotted wedge and optionally several rollers. Contact with the tube occurs only in regions of the cut edges, which are later located in the waste region of the metal sheet. Severing can take place, for example, by way of a longitudinally displaceable suction jet nozzle, a laser cutting device or the like.

After severing and bending open to obtain a U-shaped profile, the same is forwarded to the unrolling unit 4. This unit is composed of a flat base area and two movable gripping elements, wherein the gripping elements grip the longitudinal sides of the U-shaped profile and unroll the U-shaped profile to obtain a flat metal sheet.

Figure 2:
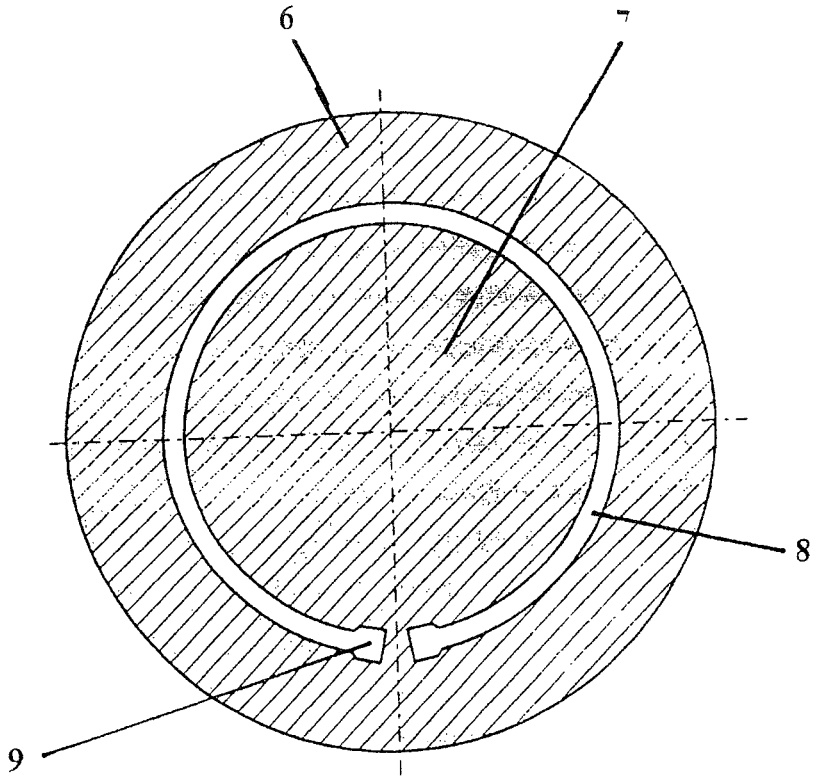
FIG. 2 shows a tool concept.

FIG. 2 shows a tool concept for a bridge die for extruding open tubular profiles 8. The bridge die is essentially composed of the die plate 6 and the mandrel part 7, between which a gap is formed that determines the wall thickness of the profile 8. Profiled ends 9 are provided at the bottom open end of the profile 8.

FIGS. 3*a* and 3*b* show variants of the profiled ends 9. These can be designed to be angled or as thickened regions.

After the open tubular profile 8 has left the extrusion press, it is expanded. In a first step, the profile 8 is cut to the appropriate length by way of a severing unit. The expanding may take place by way of forming rollers 10. As is shown in FIG. 4, these form a kind of rail guide and expand the tubular profile 8 to obtain a U-shaped profile 8.

However, it is also possible to push the longitudinal opening of the severed open tubular profile 8 onto two displaceable angled gibs 11, or the open tubular profile can be pushed onto the displaceable angled gibs 11 immediately after leaving the press die (FIG. 5*a*). The open tubular profile 8 is bent open in a U-shaped manner by moving the angled gibs 11 apart (FIG. 5*b*).

Figure 5C:
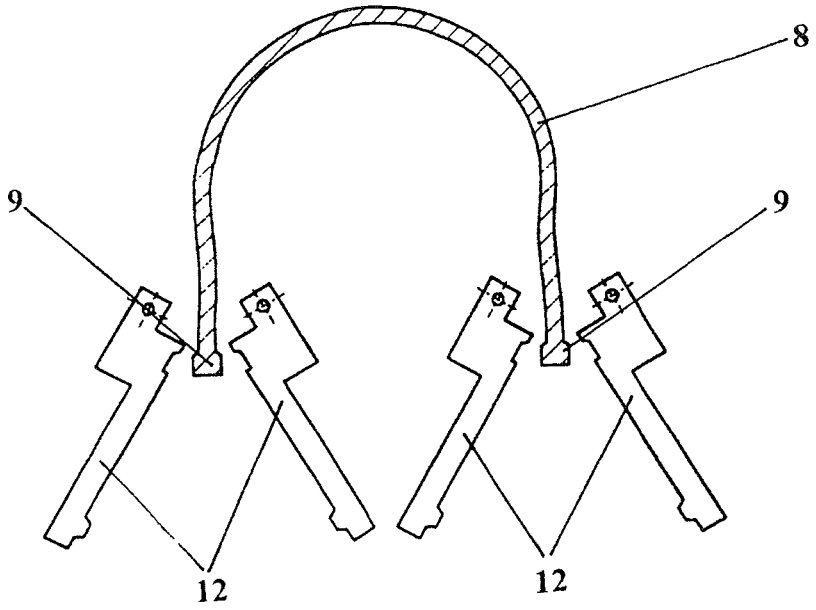
Figure 5D:
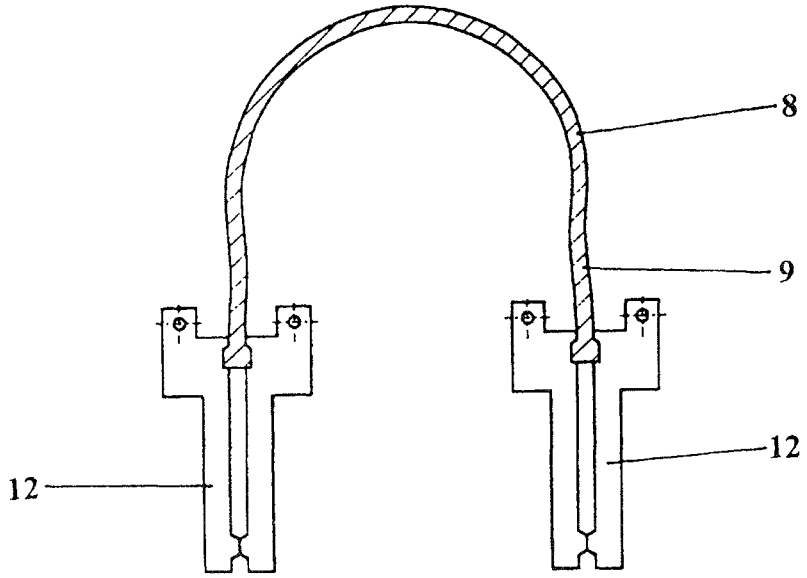
Figure 5E:
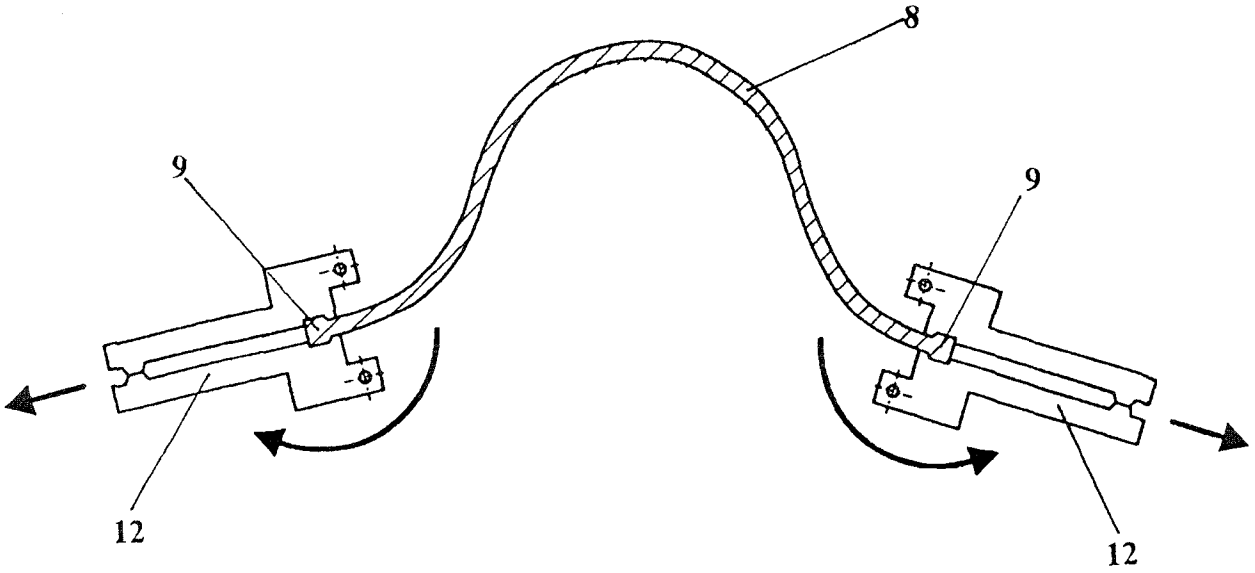

The U-shaped profile 8 is then forwarded to an unrolling unit 4. Here, the longitudinal sides of the profile 8 are gripped by way of the collets 12 (FIG. 5*c*, FIG. 5*d*) and unrolled to obtain a flat metal sheet 13 (FIG. 5*e*). The profiled ends 9 ensure secure gripping and holding of the profile 8.

The collets 12 have a floating design and are connected on one side, or on both sides, to hydraulic cylinders, whereby an adaptation to the profiled ends 9 of the longitudinal edges of the profile 8 is achieved. Slightly concave or convex deflection at the profiled ends 9 on the longitudinal edges can thus be compensated for.

Figure 5F:
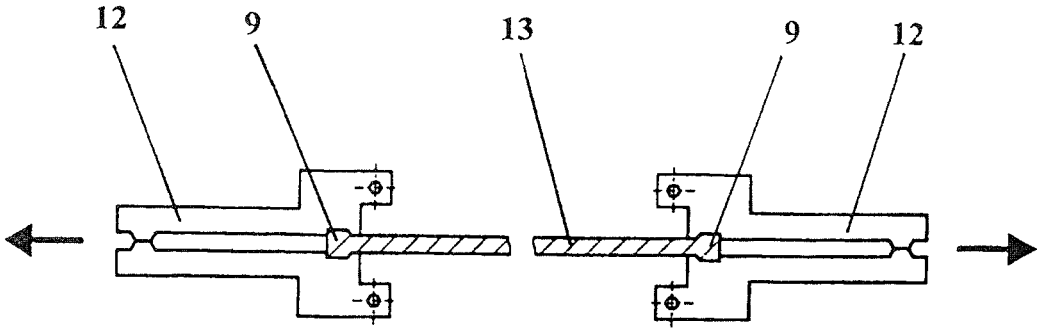
Figure 5G:
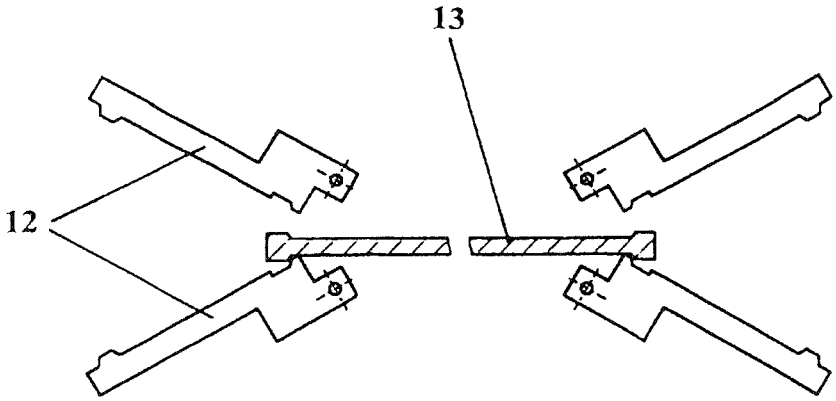

Following the hydraulic chucking process, the unrolled profile 8 is stretch-formed linearly by way of the hydraulic cylinders. The overpolishing rotational movement of the collets 12 is carried out by way of the pivotable hydraulic cylinders. In this way, the stretch-formed material is free of interfering bending forces (FIG. 5*f*).

During final stretch-forming, the floating collets 12 are oriented against fixed stops, whereby consistent stretch-forming across the entire sheet metal width is ensured. So as to minimize the heat dissipation via the collets 12, these are provided with a ceramic coating.

After the stretch-forming operation, the collets 12 are opened, and the stretch-formed metal sheet 13 is pushed out in the longitudinal direction by way of a pneumatic cylinder. The stretch-formed metal sheet 13 can subsequently be forwarded to a metal-forming working operation, for example using pressing, stamping or the like. However, it is also possible to cut the stretch-formed metal sheets 13—removing the profiled ends—and to stack the metal sheets 13.

A considerable advantage of the method and of the system is that stretch-forming of the metal sheet in the transverse direction can be carried out by way of the gripping elements. Stretch-forming in the transverse direction can be carried out in a range of 1% to 10%. As a result of stretch-forming the metal sheet, it is not only possible to decisively improve flatness, but also to achieve a thickness configuration for the metal sheet. It is also crucial that no surface defect-causing contact areas are present at what will later be the visible surfaces.

LISTS OF REFERENCE NUMERALS

1—extrusion press
2—severing unit
3—bending unit
4—unrolling unit
5—shaping unit
6—die plate
7—mandrel part
8—open profile
9—profiled ends
10—forming rollers
11—angled gibs
12—collets
13—metal sheet

The invention claimed is:

1. A method for producing metal sheets from strand-shaped profiles having a low thickness made of magnesium or magnesium alloys, an extruded tubular profile being produced and cut corresponding to the length of the metal sheet to be produced in a preceding method step, the extruded tubular profile having a longitudinal opening along a peripheral surface line thereof, characterized in that in a first step, the longitudinal opening of the extruded tubular profile is pushed onto two displaceable angled gibs and bent open to obtain a U-shaped profile by moving the angled gibs apart;

in a second step, the U-shaped profile is transferred into an unrolling unit, gripped by gripping elements on the longitudinal sides of the U-shaped profile, and shaped by outwardly moving the gripping elements to obtain a metal sheet; and in a third step, the metal sheets are subjected to defined shaping by lateral stretch-forming, wherein all steps of shaping the extruded profile to obtain the metal sheet take place in a temperature range above 200° C.

2. The method according to claim 1, characterized in that shaping of the U-shaped profile to obtain a metal sheet is additionally supported by a roller pair being moved into the U-shaped profile and each of the individual rollers being moved towards edge regions located on the longitudinal sides.

3. A method for producing magnesium or magnesium alloy metal sheets from tubular profiles, comprising:

providing an extruded tubular profile made of magnesium or magnesium alloy having a length corresponding to the length of the metal sheet to be produced and a longitudinal opening along a peripheral surface line thereof;

pushing the longitudinal opening of the extruded profile onto two displaceable angled gibs;

moving the angled gibs apart to bend open the extruded profile and form a U-shaped profile;

transferring the U-shaped profile into an unrolling unit;

gripping longitudinal sides of the U-shaped profile by gripping elements and outwardly moving the gripping elements to form a metal sheet; and stretch-forming the metal sheets to obtain a defined shape, wherein all steps of shaping the extruded profile to obtain the metal sheet are performed at a temperature above 200° C.

4. A system for producing metal sheets from an extruded tubular profile, comprising:

an extrusion press (1) comprising a die plate generating the extruded tubular profile; and a shaping unit (5) following the die plate, wherein the shaping unit (5) is composed of a severing unit (2) for cutting the extruded profile corresponding to the length of the metal sheet to be produced, a bending unit (3) for bending the extruded profile into a U-shaped profile by moving apart angled gibs, and an unrolling unit (4) having gripping elements in form of floating collets connected to hydraulic cylinders for unrolling the U-shaped profile into metal sheets and for stretch-forming the metal sheets.

5. The system according to claim 4, characterized in that the unrolling unit (4) in addition to the gripping elements comprises two movable rollers that can be moved into the U-shaped profile, wherein the individual rollers can be moved away from each other in the direction of the longitudinal edge regions.

* * * * *